US006732612B2

(12) United States Patent
Adachi et al.

(10) Patent No.: US 6,732,612 B2
(45) Date of Patent: May 11, 2004

(54) BLADE EXCHANGING DEVICE AND BLADE EXCHANGING METHOD THEREFOR

(75) Inventors: Tadashi Adachi, Mitaka (JP); Masayuki Azuma, Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 0 days.

(21) Appl. No.: 09/748,242

(22) Filed: Dec. 27, 2000

(65) Prior Publication Data

US 2001/0039863 A1 Nov. 15, 2001

(30) Foreign Application Priority Data

Dec. 27, 1999 (JP) ..... 11-370599

(51) Int. Cl.[7] ..... B26D 1/14

(52) U.S. Cl. ..... 81/13; 83/481; 83/666; 81/55

(58) Field of Search ..... 83/481, 508.2, 83/663, 665, 666, 698.41, 13; 81/13, 55

(56) References Cited

U.S. PATENT DOCUMENTS 2,601,796 A * 7/1952 Palesh, Jr. ..... 81/13
2,735,468 A * 2/1956 Green et al. ..... 83/663
3,266,535 A * 8/1966 Brodie ..... 83/666
3,682,031 A * 8/1972 DeGelleke et al. ..... 83/433
3,889,558 A * 6/1975 Duncan ..... 81/55
4,120,224 A * 10/1978 Van Steenberg et al. ..... 83/666
4,165,660 A * 8/1979 Behrens ..... 81/55
4,657,428 A * 4/1987 Wiley ..... 403/359
4,989,374 A * 2/1991 Rudolf et al. ..... 51/168
5,383,383 A * 1/1995 Garuglieri ..... 83/666
5,447,086 A * 9/1995 Wittmaier et al. ..... 83/666
5,702,415 A * 12/1997 Matthai et al. ..... 606/178
6,030,326 A * 2/2000 Azuma et al. ..... 83/666

* cited by examiner

*Primary Examiner*—Kenneth E. Peterson
*Assistant Examiner*—Omar Flores-Sánchez
(74) *Attorney, Agent, or Firm*—Nixon Peabody LLP; David S. Safran

(57) ABSTRACT

With a blade exchanging device, a cylindrical body is engaged with a nut that is fastened to a spindle, and at the same time the nut is held by fitting nails of a chuck member with grooves that are formed on the nut. Next, a torque wrench is inserted through the cylindrical body, and a polygonal head of the torque wrench is engaged with a polygonal hole formed in the head of the spindle. In this state, the spindle is rotated with the torque wrench in a direction to unfasten the nut from the spindle. The nut is thereby detached from the spindle. When the cylindrical body is disengaged from the spindle, the nut is prevented from falling off the cylindrical body, since the nails of the chuck hold the nut.

6 Claims, 9 Drawing Sheets

BLADE EXCHANGING DEVICE AND BLADE EXCHANGING METHOD THEREFOR

BACKGROUND OF THE INVENTION

1. Field of the Invention

The present invention relates generally to a blade exchanging device and a blade exchanging method therefor in order to exchange a blade of a dicing machine, which dices a semiconductor wafer.

2. Description of Related Art

A dicing machine rotates a blade at a high speed and dices a semiconductor wafer, on which many chips are formed, along the chips. In the dicing machine, the blade is fastened on a spindle with a nut, and a special blade exchanging device is used for exchanging the blade.

A conventional blade exchanging device comprises a cylindrical spanner and a sticklike torque wrench. The operator engages the spanner with the nut, and then inserts the torque wrench through a hole of the spanner so that a polygonal head of the torque wrench is engaged with a polygonal hole formed in the head of the spindle. In this state, the operator securely holds the torque wrench by one hand to prevent the wrench from rotating, and rotates the spanner by the other hand to unfasten the nut. The nut is thereby detached from the spindle. After disengaging the spanner from the spindle, the old blade is dismounted from the spindle and a new blade is mounted on the spindle. Then, the operator puts the nut on the spindle with the spanner, and rotates the spindle with the torque wrench so that the nut is fastened on the spindle. An operation for exchanging the blade using the blade exchanging device is completed by the above-described process.

However, in the conventional blade exchanging device, the nut may fall off the spanner when detaching the nut from the spindle and disengaging the spanner from the spindle. Moreover, the blade exchanging device requires the operator to use both hands, and the operator must insert both hands into a narrow space when the blade is in the narrow space, which is difficult. The blade exchanging hence used to be a troublesome operation.

SUMMARY OF THE INVENTION

The present invention has been developed in view of the above-described circumstances, and has as its object the provision of the blade exchanging device and the blade exchanging method therefor by which the nut is prevented from falling off the body of the exchanging device, and the operator can perform the exchanging operation manually with only one hand.

In order to achieve the above-described objects, the present invention is directed to a blade exchanging device with which at least one of unfastening of a blade, the blade being fastened to a spindle with a nut, from the spindle by unfastening the nut from the spindle and fastening of the blade to the spindle by fastening the nut to the spindle is performed, the blade exchanging device comprising: a cylindrical body which is engaged with the nut; a chuck which is provided inside the cylindrical body and is fitted with a fitting portion formed on the nut so as to hold the nut; and a wrench which is inserted through a hole of the chuck so as to be engaged with a hole formed in a head of the spindle, wherein one of the spindle and the nut is prevented from rotating while the other of the spindle and the nut is rotated with the wrench and the cylindrical body to perform at least one of unfastening of the nut from the spindle and fastening of the nut to the spindle.

According to the present invention, the body of the exchanging device is first engaged with the nut that is fastened to the spindle while fitting the chuck into the fitting portion that is formed on the nut so as to hold the nut. Second, the wrench is inserted through the hole of the chuck and the head of the wrench is engaged with the polygonal hole formed in the head of the spindle. In this state, one of the spindle and the nut is prevented from rotating while the other of the spindle and the nut is rotated with the wrench and the cylindrical body so as to unfasten the nut, whereby the nut is detached from the spindle. When the body of the exchanging device is detached from the spindle, the nut does not fall off the body of the exchanging device since the nut is held at the chuck. Thus, the blade exchanging device of the present invention can prevent the nut from falling off the body of the exchanging device.

Moreover, according to the present invention, the nut is held without falling off the body of the exchanging device by fitting the chuck provided to the body of the exchanging device into the fitting portion formed at the nut. Next, the nut is pressed against the body of the exchanging device while inserting the wrench through the hole of the chuck so as to engage the head of the wrench with the polygonal hole formed in the head of the spindle. Then, one of the spindle and the nut is prevented from rotating while the other of the spindle and the nut is rotated with the wrench and the cylindrical body, whereby the nut is fastened to the spindle. In this state of fastening the nut, the nut can be easily fastened since it is held by the chuck without falling off the body of the exchanging device.

Further, the blade exchanging device of the present invention is constructed in such a manner that the cylindrical body and the nut are engaged with each other by a projection and a depression provided on a circle coaxial with the spindle. Thus, the projection and the depression can be engaged with each other by only rotating either one of the body of the exchanging device or the nut with the wrench, even though in a case where the projection and the depression do not engage with each other when pressing the body of the exchanging device against the nut.

Furthermore, in the blade exchanging device of the present invention, the cylindrical body is attached to a fixed member provided nearby the blade through an arm member so as to be able to swivel, and the cylindrical body is pressed by a pressing member in a direction so that the nut is pressed against the spindle.

In such a blade exchanging device, the body of the exchanging device is first attached to the cover of the blade and at the same time is pressed against the nut with the pressing force of the pressing member. Next, the chuck is operated so as to hold the nut. Then, the wrench is inserted through the hole of the chuck and the head of the wrench is engaged with the polygonal hole of the spindle. Subsequently, the spindle is rotated by the wrench in the direction to loosen the nut, whereby the nut is detached from the spindle. Thereafter, the body of the exchanging device is retracted from the blade by swiveling the body of the exchanging device via the arm. In this state, since the nut is held by the chuck, the nut does not fall off the body of the exchanging device. Then, an old blade is detached from the spindle and a new blade is attached to the spindle. The body of the exchanging device is swiveled via the arm so as to position the body at the position facing to the spindle, and the nut held at the chuck is pressed against the spindle by the pressing force of the pressing member. After that, the spindle is rotated in the direction to fasten the nut. Thus, the nut is fastened to the spindle and the new blade is fixed to the spindle. Then, the chuck is operated so as to release the holding of the nut by the chuck. The body of the exchanging device is detached from the blade cover member. The blade exchanging operation is completed by the above-described manner, which is performed by the operator with only one hand.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

Hereunder preferred embodiments of a blade exchanging device and a blade exchanging method therefor of the present invention will be described in detail according to the accompanying drawings.

Figure 1:
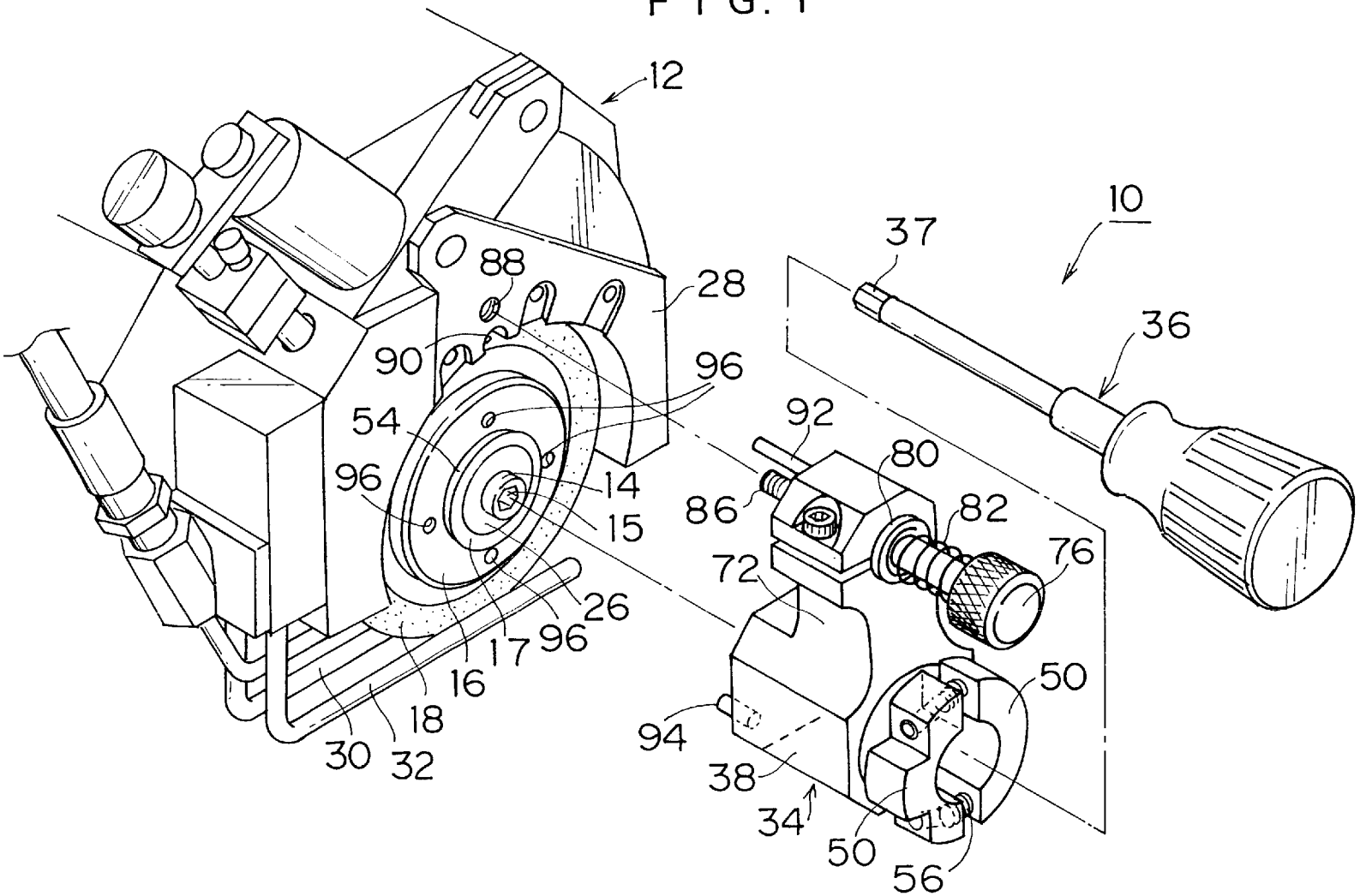
FIG. 1 is an explanatory view of a dicing machine and a blade exchanging device according to an embodiment of the present invention.
Figure 2:
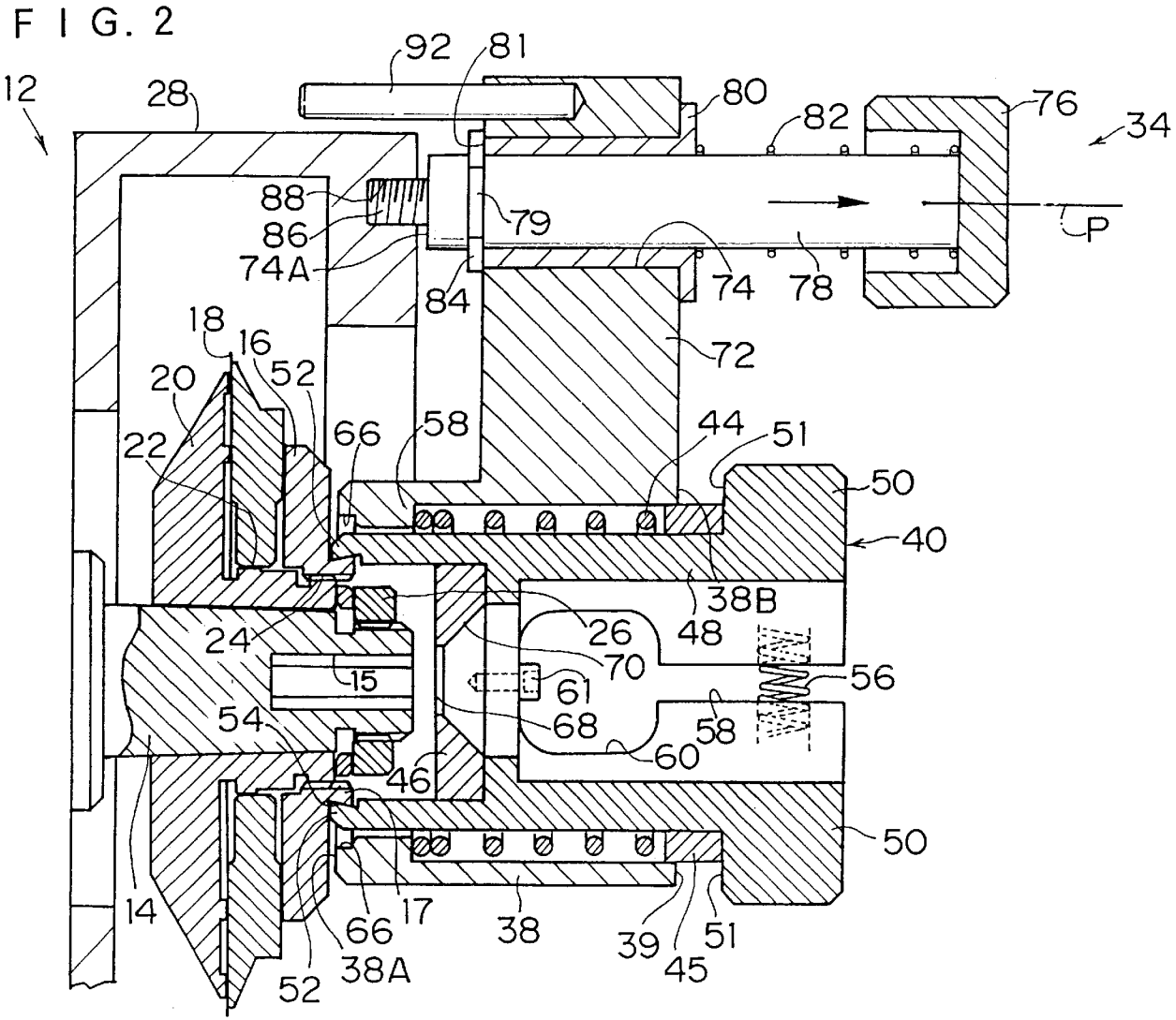
FIG. 2 is a section view showing the blade exchanging device being attached to a spindle of the dicing machine.

A blade exchanging device 10 in FIG. 1 is used to exchange a blade 18, which is fastened on a spindle 14 of a dicing machine 12 with a nut 16. As shown in FIG. 2, the blade 18 of the dicing machine 12 is mounted on an axis 22 of a flange 20, which is fitted on the spindle 14, and the blade 18 is fastened on the flange 20 with the nut 16, which is screwed down on a male screw 24 of the flange 20. Then, the blade 18 can be changed by detaching the nut 16 from the male screw 24. The flange 20 is fixed to the spindle 14 with a nut 26, which is fastened on the top end of the spindle 14, so as to be integrated with the spindle 14. Reference number 28 in FIG. 1 is a flange cover (a fixed member provided nearby the blade) for covering the blade 18, and reference numbers 30 and 32 are nozzles for supplying grinding liquid and cooling liquid to the blade 18. The dicing machine 12 which is constructed as described above rotates the blade 18 by the spindle 14 at a high speed and dices a semiconductor wafer along chips.

Figure 3:
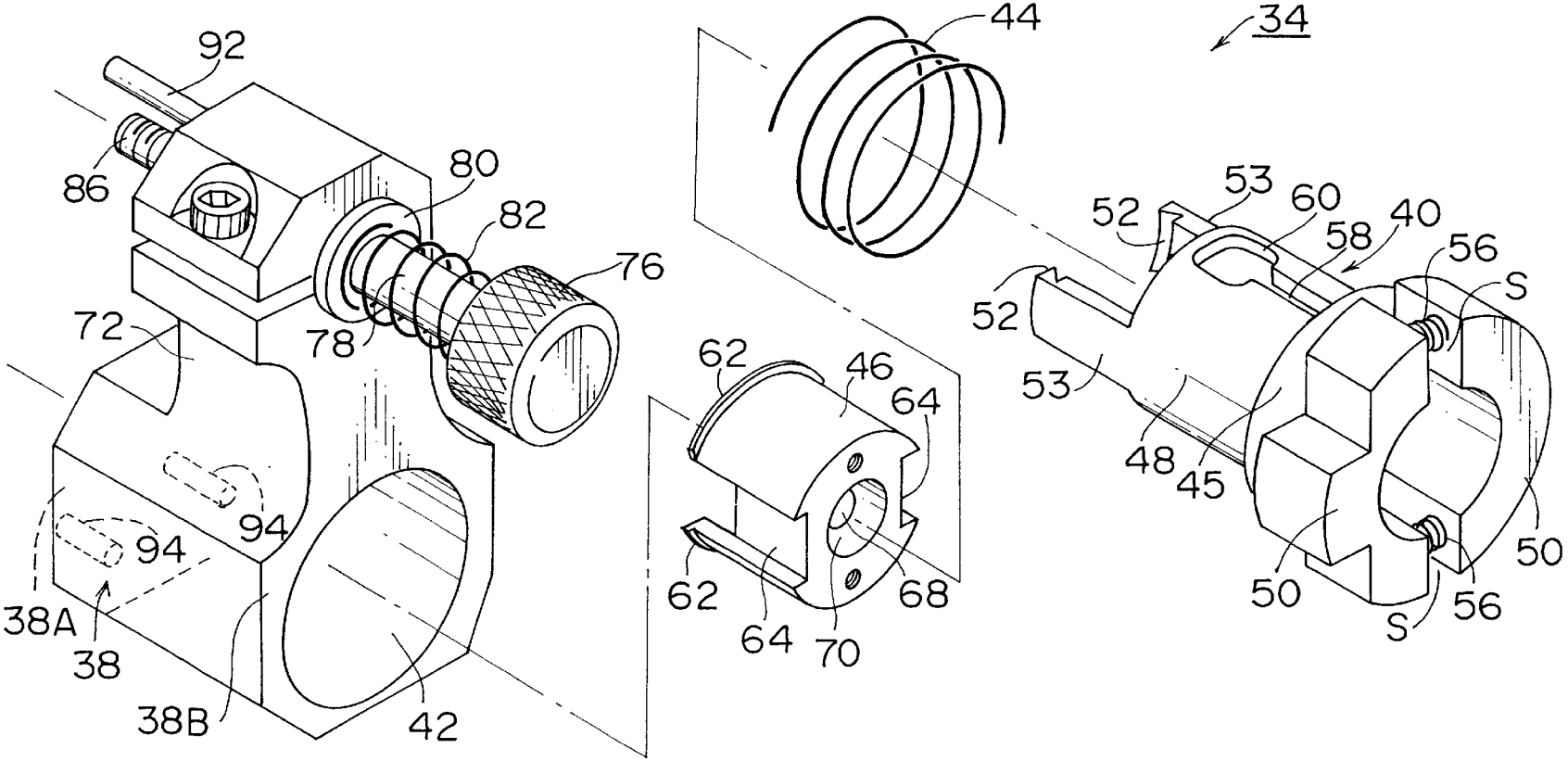
FIG. 3 is an exploded perspective view of the body of the blade exchanging device.

The blade exchanging device 10 comprises a body 34 of the exchanging device and a torque wrench 36. As shown in FIG. 3, the body 34 comprises a cylindrical body 38 and a chuck 40, which is inserted in a hole 42 of the cylindrical body 38 with a compression spring 44, a collar 45 and a stopper block 46.

The chuck 40 has a pair of tabs 50 and 50, which look like a ring divided in two by a space S at one end of a cylindrical body 48, and has a pair of nails 52 and 52, which project to face to each other at the other end of the cylindrical body 48. When the nut 16 is detached from the spindle 14 in FIG. 1, the nails 52 and 52 are fitted into a groove (a fitting portion) that is formed on the outer periphery of a boss 17 of the nut 16 as shown in FIG. 2. As shown in FIG. 3, the nails 52 and 52 are formed so as to extend from the tabs 50 and 50. When the tabs 50 and 50 are pinched to get closer to each other, and the nails 52 and 52 are moved in a direction to be further away from each other (an opening direction), and the nails 52 and 52 thereby retract from the groove 54 of the nut 16 in FIG. 2, so that their fitting with the nut 16 is released.

The tabs 50 and 50 in FIG. 3 are pressed in a direction to be away from each other by compression springs 56 and 56, which are arranged at the space S. The pressing force of the compression springs 56 and 56 is transmitted from the tabs 50 and 50 to the nails 52 and 52 through the cylindrical body 48, whereby the nails 52 and 52 are pressed in a direction to get closer to each other, that is, in a direction to fit into the groove 54 (refer to FIG. 2) of the nut 16. A slit 58 and a hollow 60 are formed at the cylindrical body 48 of the chuck 40 as shown in FIG. 3 so as to provide flexibility such that the nails 52 and 52 are easily moved by the pressing forces of the pinch of the tabs 50 and 50 and of the compression springs 56 and 56.

As shown in FIG. 2, the compression spring 44 is arranged in a space between the cylindrical body 38 and the cylindrical body (main body) 48. The compression spring 44 is also arranged between a step 58 formed on the inner periphery of the cylindrical body 38 and the collar 45 mounted on the cylindrical body 48. The chuck 40 is pressed to the right in FIG. 2 by the compression spring 44.

A stopper block 46 is fastened to the chuck 40 with a screw 61. A flange 62 and a pair of grooves 64 and 64 are formed on the outer periphery of the stopper block 46 as shown in FIG. 3. The flange 62 is engaged with a groove 66 in FIG. 2 formed at the inner periphery of the cylindrical body 38. Thereby, the chuck 40 is pressed to the right in FIG. 2 by the compression spring 44 while the chuck 40 is prevented from falling off the cylindrical body 38 since the flange 62 of the stopper block 46 is engaged with the groove 66 of the cylindrical body 38. If the chuck 40 is pressed to the left in FIG. 2 against the pressing force of the compression spring 44, the nails 52 and 52 project from the left end surface 38A of the cylindrical body 38 and at the same time faces 51 and 51 of the tabs 50 and 50 are in contact with the right end surface 38B of the cylindrical body 38, whereby the pressing amount of the chuck 40 is regulated. Arms 53 and 53 of the nails 52 and 52 of the chuck 40 are fitted in the grooves 64 and 64 of the stopper block 46 in FIG. 3. A hole 68 is opened at the center of the stopper block 46, and a tapered surface 70 is formed around the hole 68. The torque wrench 36 in FIG. 1 is inserted through the hole 68 under guidance of the tapered surface 70.

An arm (arm member) 72 is projected from the cylindrical body 38, and a rod 78, on which a knob 76 is formed, is slidably and rotatably inserted through a top end opening 74 (shown in FIG. 2) of the arm 72 via a sleeve bearing 80. A compression spring (pressing member) 82 is arranged between the knob 76 and the sleeve bearing 80. The rod 78 is inserted through the compression spring 82 and is pressed to the right direction in FIG. 2 by the pressing force of the compression spring 82. An E-washer 84 is fitted on the periphery of an end 79 of the rod 78, which is inserted through the sleeve bearing 80. The E-washer 84 is in contact with an end surface 81 of the sleeve bearing 80 so as to prevent the rod 78 from falling off the sleeve bearing 80.

A male screw 86 is projected on the end surface 74A of the rod 78, and the male screw 86 is coaxial with the rod 78. The male screw 86 is screwed into a threaded hole 88, which is formed at the flange cover 28 in FIG. 1. The body 34 of the exchanging device is thereby attached to the flange cover 28 as shown in FIG. 2, so that the cylindrical body 38 is supported to be able to swivel with respect to the flange cover 28 in which the axis of the male screw 86 is the center, that is, the axis P of the rod 78 is the center of the swiveling.

The swiveling range of the cylindrical body 38 is set between an exchangeable position where the nails 52 and 52 of the chuck 40 fit in the groove 17 of the nut 16 and a retracting position where a pin 92 provided on the body 34 of the exchanging device engages with an arched groove 90 formed on the flange cover 28. In the retracting position, the cylindrical body 38 swivels from the exchangeable position by 180 degrees and is retracted above the blade 18. When the cylindrical body 38 is at this retracting position, the blade 18 can be detached from the spindle 14.

Two pins (projections) 94 and 94 are projected on the left end surface 38A of the cylindrical body 38 in FIG. 3. The pins 94 and 94 are engaged with two of four holes 96 (depressions), which are formed on the surface of the nut 16 in FIG. 1. The nut 16 is thereby fixed to the cylindrical body 38. The holes 96 are formed on a circle, which is coaxial with the nut 16 and the spindle 14, at every 90 degrees, and the pins 94 and 94 are engaged with the two holes 96 and 96 that face to each other across the spindle 14.

A method will be described for exchanging a blade by the blade exchanging device 10 which is constructed as described above.

Figure 4:
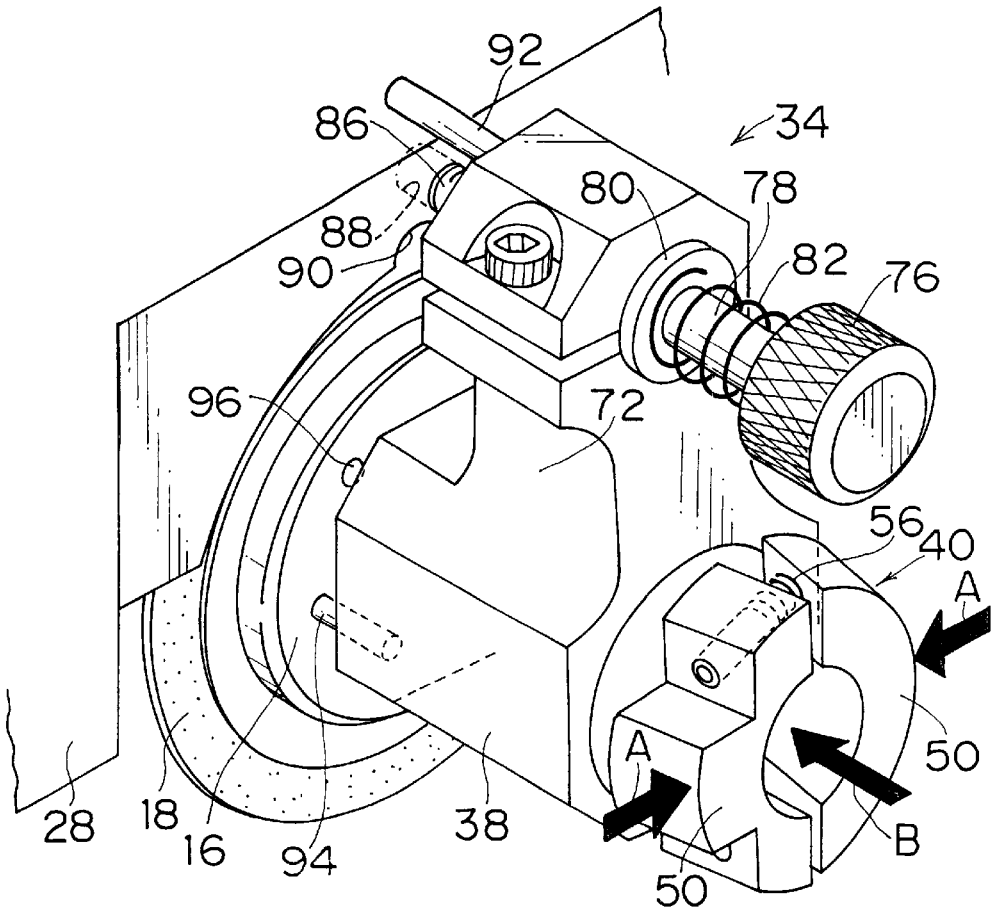
FIG. 4 is an explanatory view of a blade exchanging method with the blade exchanging device.

First, as shown in FIG. 4, the male screw 86 of the body 34 of the exchanging device is screwed into the threaded hole 88 of the flange cover 28 so as to attach the body 34 to the flange cover 28. The cylindrical body 38 is positioned at the exchangeable position where the nails 52 and 52 of the chuck 40 fit in the groove 17 of the nut 16. At this point, the cylindrical body 38 is pressed toward the nut 16 since the pressing force of the compression spring 82 is transmitted to the cylindrical body 38 through the arm 72. At this point also, the nut 16 is not fixed to the cylindrical body 38 since the pins 94 are not engaged with the holes 96. In addition, if the holes 96 are already positioned at the facing positions of the pins 94, the nut 16 is fixed to the cylindrical body 38 since the pins 94 are directly engaged with the holes 96.

Next, the tabs 50 and 50 of the chuck 40 are pinched with fingers of the operator in the direction represented by arrows A in FIG. 4, and the chuck 40 is pressed into the nut 16 in the direction represented by an arrow B in this state. As the operator's fingers are released from the tabs 50 and 50, the tabs 50 and 50 return at the original position by the pressing force of the compression springs 56 and 56. Thereby, the nails 52 and 52 of the chuck 40 fit in the groove 54 of the nut 16 as shown in FIG. 2.

Figure 5:
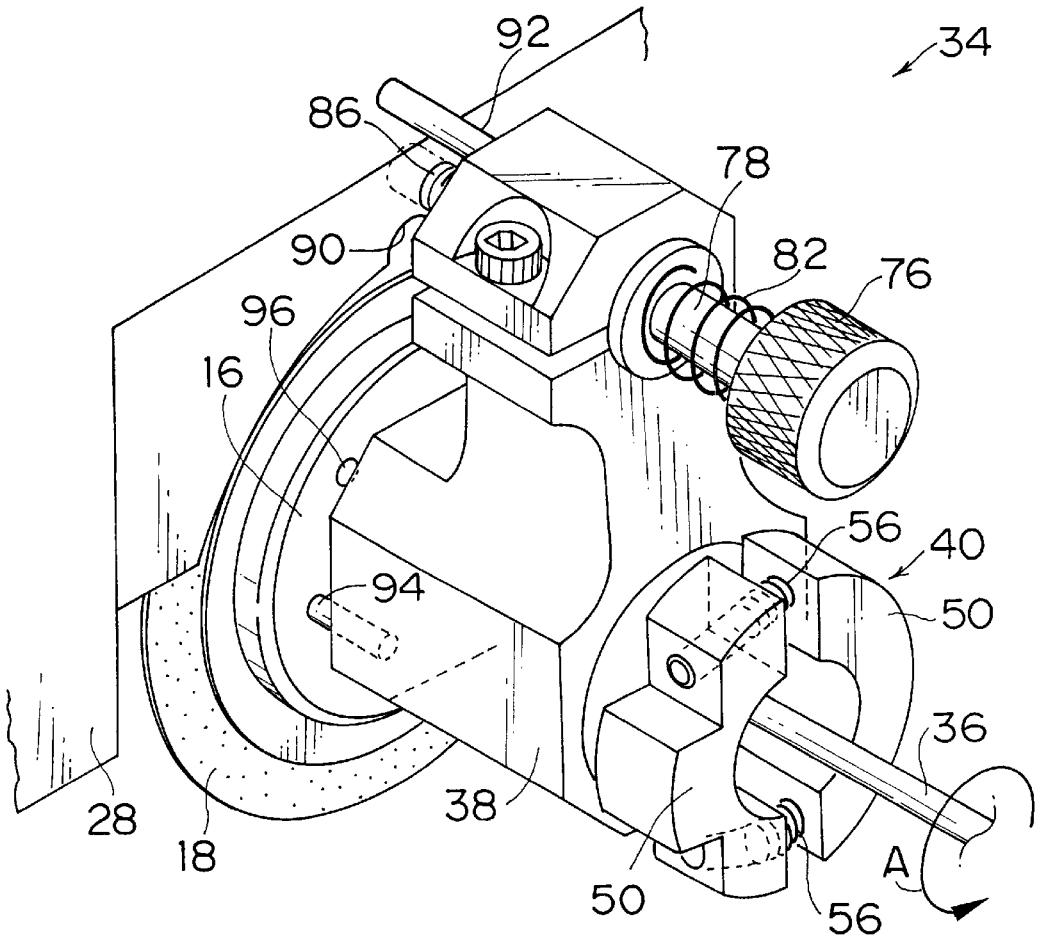
FIG. 5 is another explanatory view of a blade exchanging method with the blade exchanging device.
Figure 6:
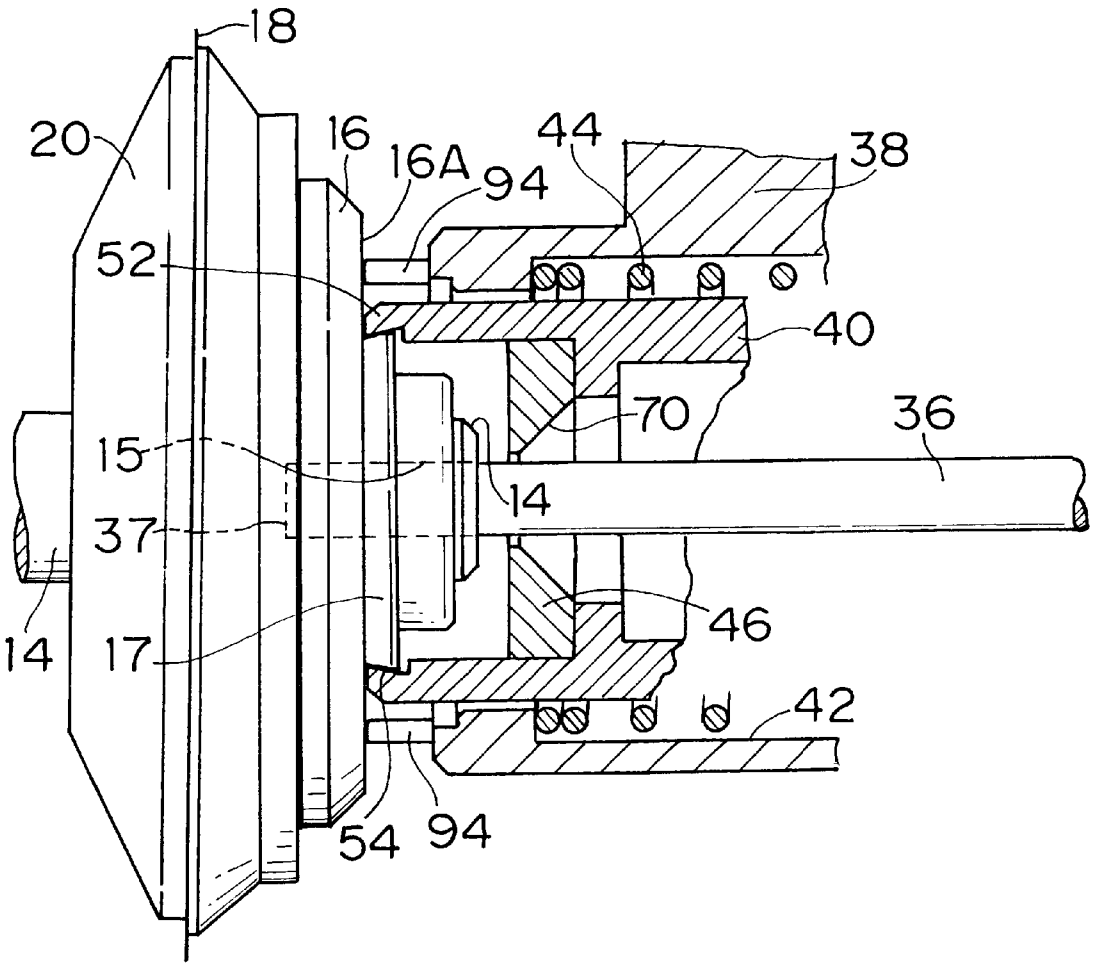
FIG. 6 is still another explanatory view of the blade exchanging method with the blade exchanging device.
Figure 7:
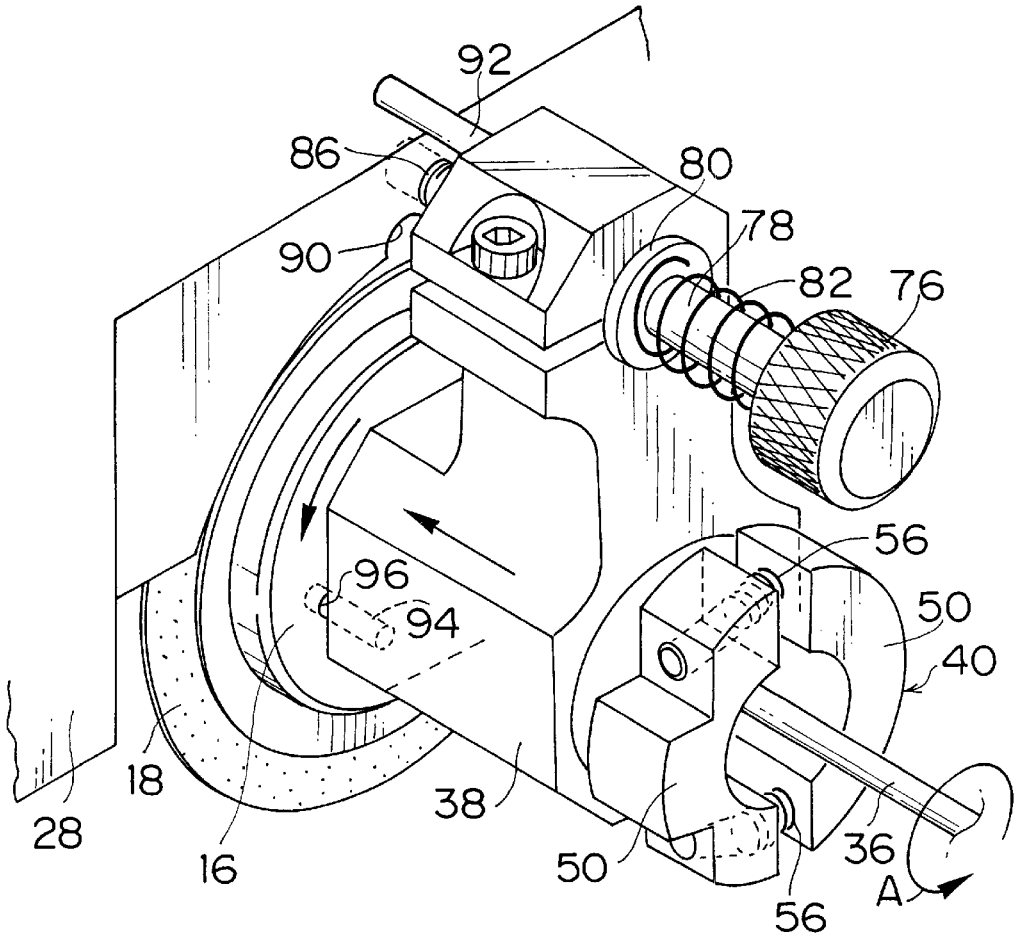
FIG. 7 is still another explanatory view of the blade exchanging method with the blade exchanging device.
Figure 8:
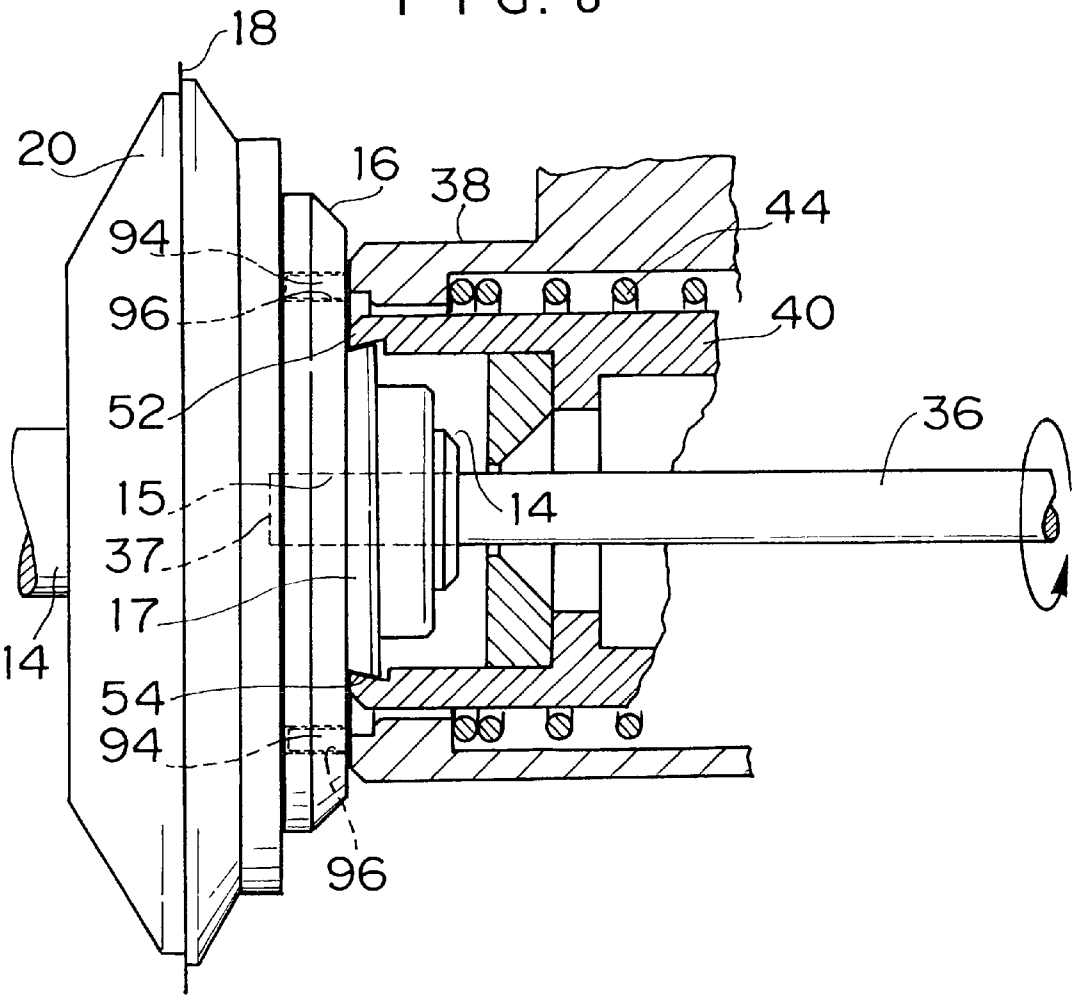
FIG. 8 is still another explanatory view of the blade exchanging method with the blade exchanging device.

Next, as shown in FIGS. 5 and 6, the torque wrench 36 is inserted through the hole of the chuck 40 and through the hole 68 of the stopper block 46 so that a polygonal head 37 of the torque wrench 36 is engaged with a polygonal hole 15 of the spindle 14. After that, as rotating the spindle 14 with the torque wrench 36 by a predetermined amount in the direction to unfasten the nut 16 represented by an arrow A in FIG. 5, the nut 16 is rotated together with the spindle 14, and the pins 94 of the nut 16 are fitted in the holes 96 of the nut 16 as shown in FIGS. 7 and 8; thereby the nut 16 is automatically fixed to the cylindrical body 38 so that the nut 16 is prevented from rotating with respect to the cylindrical body 38.

Then, the spindle 14 is rotated by the torque wrench 36 in the direction to unfasten the nut 16 (the direction represented by the arrow A in FIG. 7), whereby the nut 16 is gradually loosened and is detached from the spindle 14.

Figure 9:
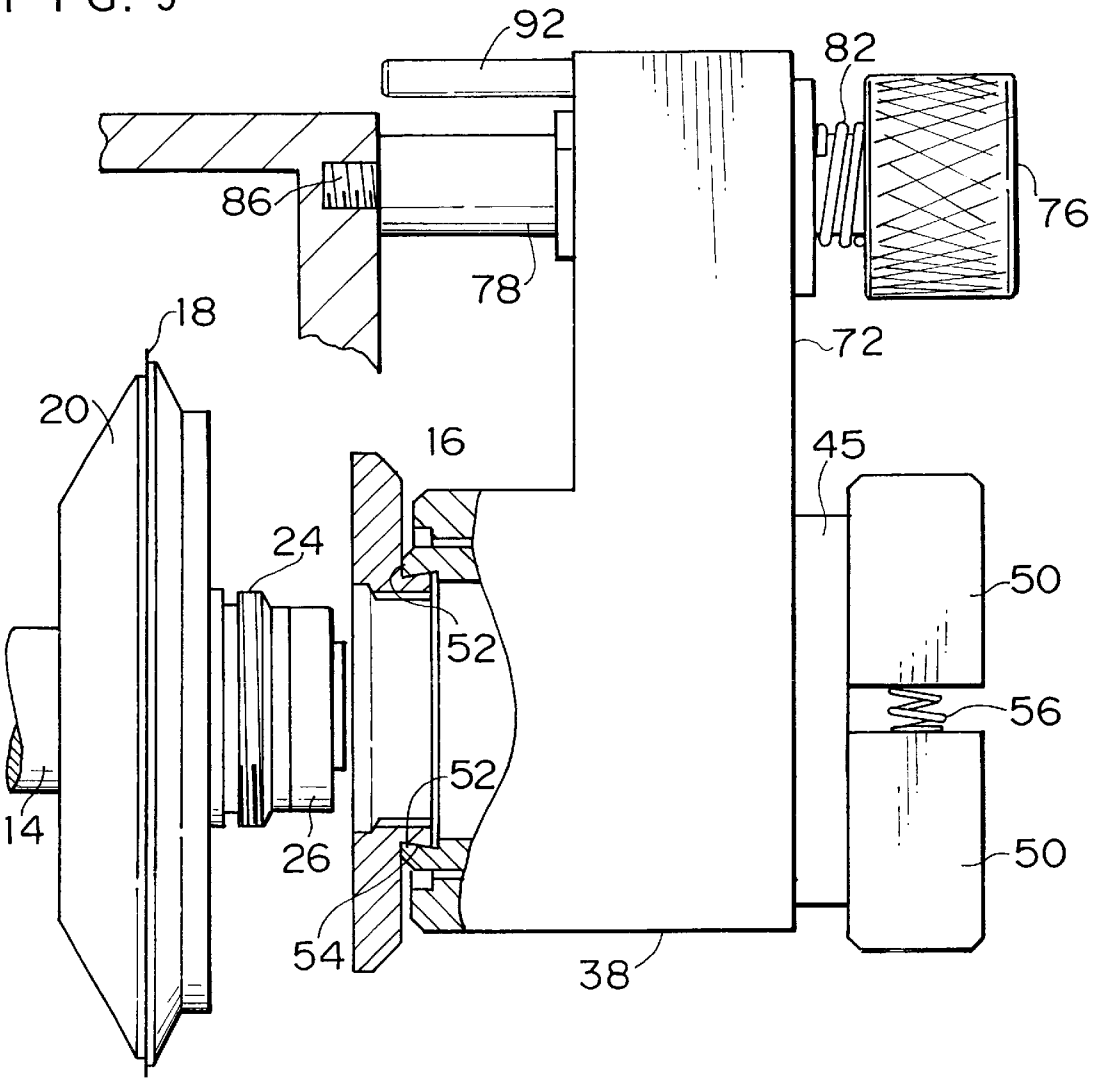
FIG. 9 is still another explanatory view of the blade exchanging method with the blade exchanging device.

When the nut 16 is completely detached from the spindle 14, the cylindrical body 38 is pulled out of the spindle 14 as shown in FIG. 9 against the pressing force of the compression spring 82. At that time, the nut 16 is held by the nails 52 and 52 of the chuck 40, so that the nut 16 does not fall off the cylindrical body 38. After that, the cylindrical body 38 is swiveled via the arm 72 by 180 degrees so as to engage the pin 92 with the groove 90, and the cylindrical body 38 is held at the position retracting from the blade 18.

Then, the old blade 18 is dismounted from the spindle 14, and a new one is mounted on the spindle 14. The engaging of the pin 92 with the groove 90 is released by pulling the cylindrical body 38 so as to retract the pin 92 from the groove 90. Subsequently the cylindrical body 38 is swiveled by 180 degrees via the arm 72 so as to position the cylindrical body 38 at the exchangeable position facing to the spindle 14. The nut 16, which is held by the nails 52 and 52 of the chuck 40, is thereby pressed against the male screw 24 by the pressing force of the compression spring 82. Then, the spindle 14 is rotated by using the torque wrench 16 in the direction to fasten the nut 16. Thereby, the nut 16 is fastened to the male screw 24 and the new blade 18 is fixed to the spindle 14.

Next, the tabs 50 and 50 of the chuck 40 are pinched so that the nails 52 and 52 release the nut 16. The rod 78 is rotated to unfasten the male screw 86 from the threaded hole 88, so that the main body 34 of the exchanging device is detached from the flange cover 28. The blade exchanging operation is completed by the above-described process.

The blade exchanging device 10 of the present invention is provided with the chuck 40 for holding the nut 16; thus, the nut 16 detached from the spindle 14 is prevented from falling off the cylindrical body 38.

Moreover, the blade exchanging device 10 is constructed in which the nut 16 is fixed to the cylindrical body 38 by the pins 94 and the holes 96, which are arranged on the circle coaxial with the nut 16. Therefore, even though the pins 94 do not engage with the holes 96 when the cylindrical body 38 is pressed against the nut 16, the holes 96 can be automatically engaged with the pins 94 by only rotating the spindle 14, with which the nut 16 is rotated, with the torque wrench 36 by a predetermined amount, because the cylindrical body 38 is pressed against the nut 16 by the compression spring 82.

Further, the operator can perform the exchanging operation of the blade 18 described above by only one hand, and thus the exchanging operation can also be easily performed in a narrow place.

If the body 34 of the exchanging device is constructed with the cylindrical body 38 only and does not have the arm 72, the nut 16 is detached from the spindle 14 by the following procedure. First, the cylindrical body 38 is engaged with the nut 16 which is fastened to the spindle 14 while holding the nut 16 by the nails 52 and 52 of the chuck 40. The torque wrench 36 is inserted through the hole of the chuck 40 so that the torque wrench 36 is engaged with the spindle 14. In this state, one of the nut 16 and the spindle 14 is prevented from rotating while the other is rotated in the loosening direction, by the cylindrical body 38 and the torque wrench 36. The nut 16 is thus detached from the spindle 14. At that time, the nut 16 is prevented from falling off the cylindrical body 38, since the chuck 40 holds the nut 16.

In a case of fastening the nut 16, first, the nut 16 is held by the nails 52 of the chuck 40 to be prevented from falling off the cylindrical body 38. Second, the nut 16 is pressed against the spindle 14 while inserting the torque wrench 36 through the hole of the chuck 40 so that the torque wrench 36 is engaged with the spindle 14. Then, one of the nut 16 and the spindle 14 is prevented from rotating while the other is rotated so that the nut 16 is fastened to the spindle 14, by the cylindrical body 38 and the torque wrench 36. Since the nut 16 is held by the chuck 40 to be prevented from falling off the cylindrical body 38, the nut 16 can be easily fastened.

As described above, in the blade exchanging device and the exchanging method therefor of the present invention, the nut detached from the spindle does not fall off the body of the exchanging device since the chuck for holding the nut is provided.

Furthermore, the present invention is constructed in such a manner that the nut can be fixed to the body of the exchanging device by the projections and the depressions provided on the circles coaxial with the nut. Thus, even though the projections do not engage with the depressions when pressing the body of the exchanging device onto the nut, the projections and the depressions can be easily engaged with each other by only rotating the nut with the wrench by the predetermined amount.

In addition, the blade exchanging operation of the blade exchanging device of the present invention can be performed manually by the operator using only one hand.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for exchanging a blade, wherein the blade is mounted on a spindle and is fastened to the spindle by fastening a nut to the spindle, the method comprising the steps of:

manually mounting the blade on the spindle without the nut;

holding the nut in an unfastened condition by engaging portions of a chuck with a fitting portion formed on the nut, the chuck being provided to a body of an exchanging device and said portions of the chuck being shaped to hold the nut to prevent the nut from falling off the body of the exchanging device irrespective of whether the nut is on the spindle;

pressing the nut, which has a plurality of depression holes in a surface which will engage the body, against the spindle with the body of the exchanging device, by engaging a plurality of projection pins on a surface of body with the depression holes of the nut;

inserting a wrench through a hole of the chuck so as to engage a head of the wrench with a hole formed in a head of the spindle; and fastening the nut to the spindle by preventing one of the spindle and the nut from rotating while rotating the other of the spindle and the nut with the wrench and the cylindrical body.

2. A method for exchanging a blade, wherein the blade is fastened to a spindle with a nut and is unfastened from the spindle by unfastening the nut from the spindle, the method comprising the steps of:

engaging a body of an exchanging device, having a plurality of projection pins extending from a surface of the body, with the nut being fastened to the spindle in which the nut has a plurality of complementary depression holes formed in a surface of the nut by inserting each pin of the body in a complementary hole in the nut;

holding the nut by engaging portions of a chuck with a fitting portion formed on the nut, the chuck being provided to the body of the exchanging device and said portions of the chuck being shaped to hold the nut to prevent the nut from falling off the body of the exchanging device irrespective of whether the nut is on the spindle;

inserting a wrench through a hole of the chuck so as to engage a head of the wrench with a hole formed in a head of the spindle;

unfastening the nut from the spindle by preventing one of the spindle and the nut from rotating while rotating the other of the spindle and the nut with the wrench and the cylindrical body, the nut being retained by said portions upon unfastening thereof;

removing the nut without the blade; and subsequently, manually removing the blade.

3. A blade exchanging device for enabling manual exchanging of a blade that is fastened to a spindle with a nut, comprising:

a cylindrical body which is engaged with a nut;

a chuck which is provided inside the cylindrical body and which has portions shaped to engage with a fitting portion formed on the nut to prevent the nut from falling off the cylindrical body so as to hold the nut irrespective of whether the nut is on the spindle; and a wrench which is inserted through a hole of the chuck so as to be engaged with a hole formed in a head of the spindle, wherein one of the spindle and the nut is prevented from rotating while the other of the spindle and the nut is rotated with the wrench and the cylindrical body to perform at least one of unfastening of the nut from the spindle and fastening of the nut to the spindle; and wherein means are provided for pressing the entire chuck and the nut engaged therewith in a direction away from the blade on the spindle, and wherein the cylindrical body is attached to a fixed member provided nearby the blade through an arm member so as to be able to swivel, and the cylindrical body is pressed by a pressing member in a direction so that the nut is pressed against the spindle.

4. A blade exchanging device for exchanging of a blade that is fastened to a spindle with a nut, comprising:

a cylindrical body which is engaged with a nut;

a chuck which is provided inside the cylindrical body and which has portions shaped to engage with a fitting portion formed on the nut so as to hold the nut irrespective of whether the nut is on the spindle; and a wrench which is inserted through a hole of the chuck so as to be engaged with a hole formed in a head of the spindle, wherein one of the spindle and the nut is prevented from rotating while the other of the spindle and the nut is rotated with the wrench and the cylindrical body to perform at least one of unfastening of the nut from the spindle and fastening of the nut to the spindle; and wherein the portions of the chuck shaped to engage with the fitting portion formed on the nut are formed on tabs that are movable toward and away from each other, and wherein said fitting portion is a groove formed on the nut in which said portions of the chuck are engaged when the tabs are held in a position moved toward each other.

5. A blade exchanging device for enabling manual exchanging of a blade that is fastened to a spindle with a nut, comprising:

a cylindrical body having pin projections extending from a surface which is engaged with a nut which has depression holes on a surface engaged with the cylindrical body;

a chuck which is provided inside the cylindrical body and which has portions shaped to engage with a fitting portion formed on the nut to prevent the nut from falling off the cylindrical body so as to hold the nut irrespective of whether the nut is on the spindle; and a wrench which is inserted through a hole of the chuck so as to be engaged with a hole formed in a head of the spindle, wherein one of the spindle and the nut is prevented from rotating while the other of the spindle and the nut is rotated with the wrench and the cylindrical body to perform at least one of unfastening of the nut from the spindle and fastening of the nut to the spindle; and wherein means are provided for pressing the entire chuck and the nut engaged therewith in a direction away from the blade on the spindle, and wherein the cylindrical body and the nut are engaged with each other via insertion of each projection pin into an complementary depression hole in the nut.

6. The blade exchanging device as defined in claim 5, wherein the cylindrical body is attached to a fixed member provided nearby the blade through an arm member so as to be able to swivel, and the cylindrical body is pressed by a pressing member in a direction so that the nut is pressed against the spindle.

* * * * *